US007269926B1

(12) United States Patent
Rakosi

(10) Patent No.: US 7,269,926 B1
(45) Date of Patent: Sep. 18, 2007

(54) DOMED BUILDING STRUCTURE

(75) Inventor: Ferenc Rakosi, New York, NY (US)

(73) Assignee: Stanley S. Milic, Scottsdale, AZ (US)

( * ) Notice: Subject to any disclaimer, the term of this patent is extended or adjusted under 35 U.S.C. 154(b) by 946 days.

(21) Appl. No.: 10/399,106

(22) PCT Filed: Oct. 16, 2000
(Under 37 CFR 1.47)

(86) PCT No.: PCT/GB00/03966

§ 371 (c)(1),
(2), (4) Date: Apr. 15, 2003

(87) PCT Pub. No.: WO02/33186

PCT Pub. Date: Apr. 25, 2002

(51) Int. Cl.
*E04B 7/08* (2006.01)

(52) U.S. Cl. ..... 52/81.1; 52/80.1; 52/81.2

(58) Field of Classification Search ..... 52/81.1, 52/80.1, 81.2, 81.5, 648.1
See application file for complete search history.

(56) References Cited

U.S. PATENT DOCUMENTS 2,918,992 A * 12/1959 Gelsavage ..... 52/81.1
3,925,940 A * 12/1975 O'Connell et al. ..... 52/81.1
4,194,327 A 3/1980 Simone
4,263,758 A * 4/1981 Seaich ..... 52/81.1
4,285,174 A 8/1981 Knight
4,306,392 A 12/1981 SoRelle
4,422,267 A * 12/1983 Whitehouse ..... 52/81.1
4,608,789 A * 9/1986 Willis ..... 52/81.1
4,665,664 A 5/1987 Knight
4,686,801 A 8/1987 Eriksson et al.
4,788,803 A 12/1988 Seitz
5,170,599 A 12/1992 Knight
5,377,460 A 1/1995 Hicks
6,134,849 A * 10/2000 Holler ..... 52/80.1
6,647,672 B1 * 11/2003 Knight ..... 52/81.4

FOREIGN PATENT DOCUMENTS

EP 0 773 331 A1 5/1997
GB 2 339 806 A 2/2000

* cited by examiner

*Primary Examiner*—Basil Katcheves
(74) *Attorney, Agent, or Firm*—Kirk D. Houser; Eckert Seamans Cherin & Mellott, LLC

(57) ABSTRACT

A dome-like structure is disclosed which is non-circular in plan, the structure being formed of a plurality of substantially straight-edged panels. At each of a plurality of horizontal levels in the structure the edges of the panels each extend between a respective pair of points on a notional envelope of the structure. The structure is so designed that, at each said level, the points do not all lie upon a common circle, but that for each set of three adjacent horizontally spaced said points, either: a) all three are at equal radii from a point in the same plane, or b) two adjacent ones of the three points are at a first equal radial distance from a point in said plane and the remaining point is at the same distance as the adjoining point of said set from a point on a radius from the point to said adjoining point.

8 Claims, 8 Drawing Sheets

DOMED BUILDING STRUCTURE

BACKGROUND OF THE INVENTION

1. Field of the Invention

The invention relates to domed building structures and, in particular, to a domed building structure having a framework of spars each extending between a respective pair of points on a notional envelope of the framework assembled from a plurality of individual panels.

2. Background Information

Domed building structures of this general type are disclosed, for example, in U.S. Pat. Nos. 4,285,174; 4,665,664; 4,686,801 and 5,170,599, and in European Patent Application No. EP-0773331A, to which reference should be had.

European Patent Application 0773331 discloses a domed building structure comprising a plurality of substantially concentric parts disposed one above the other and including a central upper apex part and one or more lower parts each forming a respective frustum adjoining the part immediately above, and wherein each said frustum is formed of a plurality of straight-edged panels, each extending from the upper inner edge of the frustum to the lower outer edge, each junction between panel edges at each said upper inner edge of the or each frustum being coincident with a respective junction between panel edges at the adjoining edge of the frustum or central upper part immediately above, and at least one said frustum comprising both four-sided and triangular panels, with each triangular panel having an apex coincident with a junction between four-sided panels in the upper inner edge of the respective frustum, and having a base forming a respective part of the lower outer edge of the respective frustum.

GB-2339806 discloses such a structure in which, additionally, each said four sided panel is trapezoidal, with the shorter of its parallel edges lying in the lower, outer, edge of the frustum and the longer of its parallel edges lying in the upper, inner edge of the frustum.

Known domed building structures of this type are generally substantially circular in plan and exhibit, from a microscopic viewpoint, substantial rotational symmetry about a vertical central axis. This form has the advantages of strength and stability, but there are, of course, circumstances in which a circular ground plan, for example is not ideal from other considerations, for example where it is desired that the dome should encompass a rectangular, or otherwise non-circular sports pitch, or where it is desired to make the most efficient use, in terms of utilisation of plan area, of a generally rectangular site, or to fit a plurality of similar structures close together on the ground without waste of space.

SUMMARY OF THE INVENTION

It is an object of the present invention to provide a dome-like structure which is non-circular in plan yet nevertheless retains other advantages, such as rigidity and stability, of known dome structures of generally circular plan.

According to the present invention, there is provided a dome-like structure which is non-circular in plan, the structure being formed of a plurality of substantially straight-edged panels, as herein defined, the edges of said panels each extending between a respective pair of points on a notional envelope of the structure, and wherein said points are disposed at selected ones of a plurality of horizontal levels in the structure and wherein, at each said level, said points do not all lie upon a common circle, but wherein, for each set of three adjacent horizontally spaced said points, either (a) all three are at equal radii from a point in the same plane, or (b) two adjacent ones of the three points are at a first equal radial distance from a point in said plane (herein for convenience termed a locator point) and the remaining point is at the same distance as the adjoining point of said set from a point on a radius from said locator point to said adjoining point or from a point on the production, beyond said locator point, of the last-mentioned radius.

In preferred embodiments, the domed building structure, like some known dome structures, comprises a plurality of parts disposed one above the other and includes an upper apex part and one or more lower parts each forming a respective frustum adjoining the part immediately above.

Each said frustum may be formed of a plurality of panels each extending from the upper inner edge of the frustum to the lower outer edge.

BRIEF DESCRIPTION OF THE DRAWINGS

Embodiments of the invention are described below by way of example with reference to the accompanying drawings in which.

DESCRIPTION OF THE PREFERRED EMBODIMENTS

Figure 1:
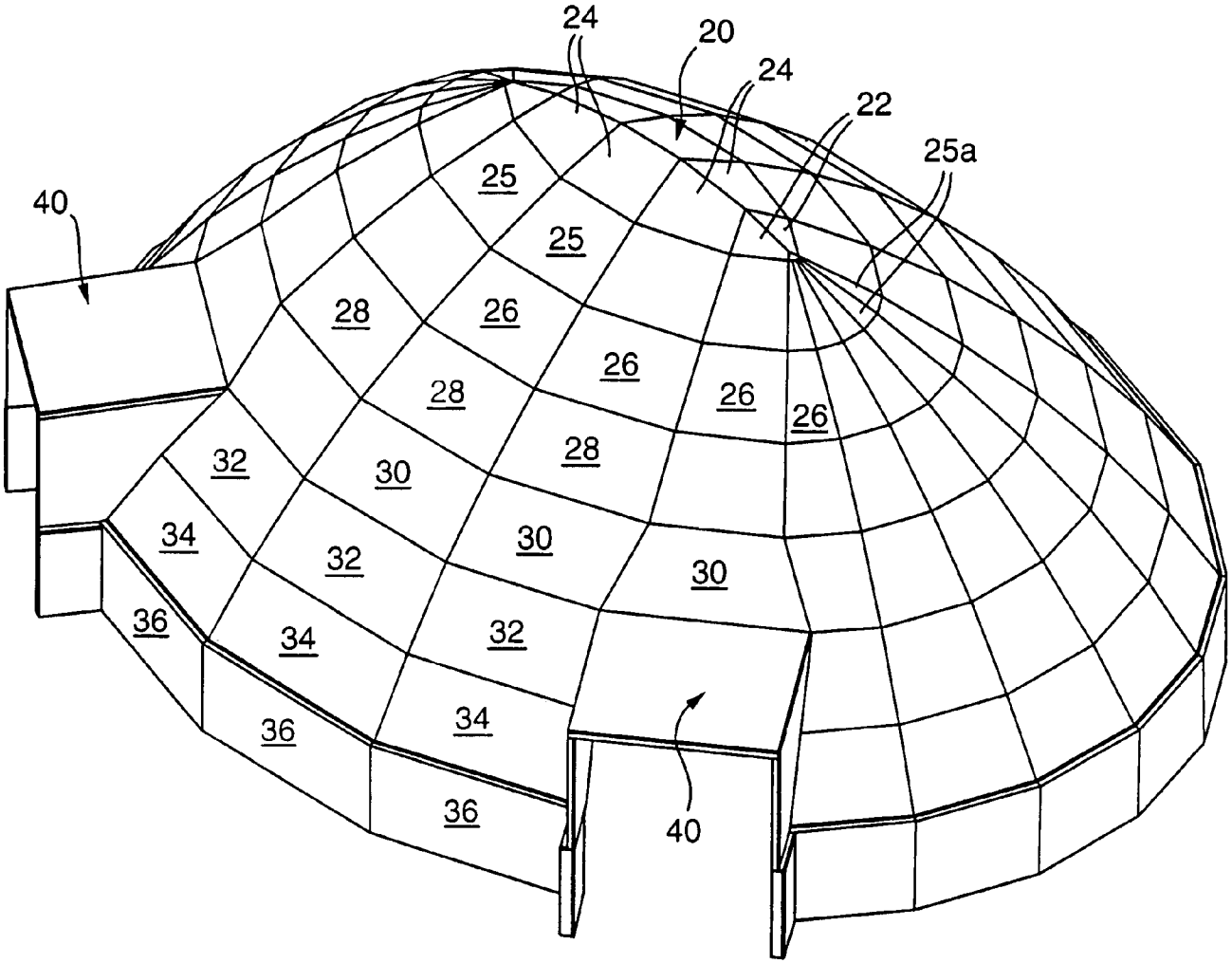
FIG. 1 is a perspective view from above of a first dome-like structure embodying the invention.
Figure 2:
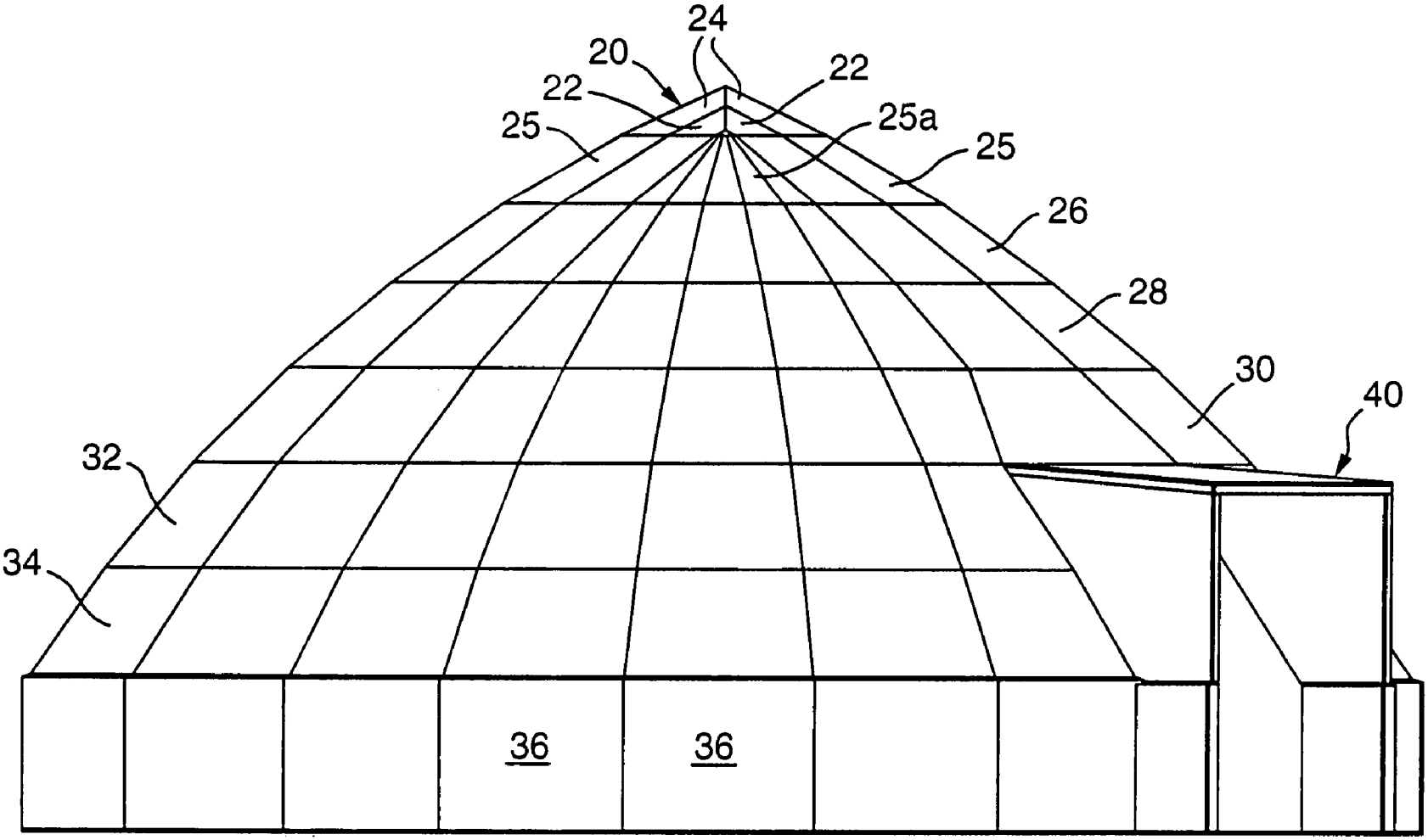
FIG. 2 is an end elevation view, and FIG. 3 a side elevation view, of the structure of FIG. 1.
Figure 3:
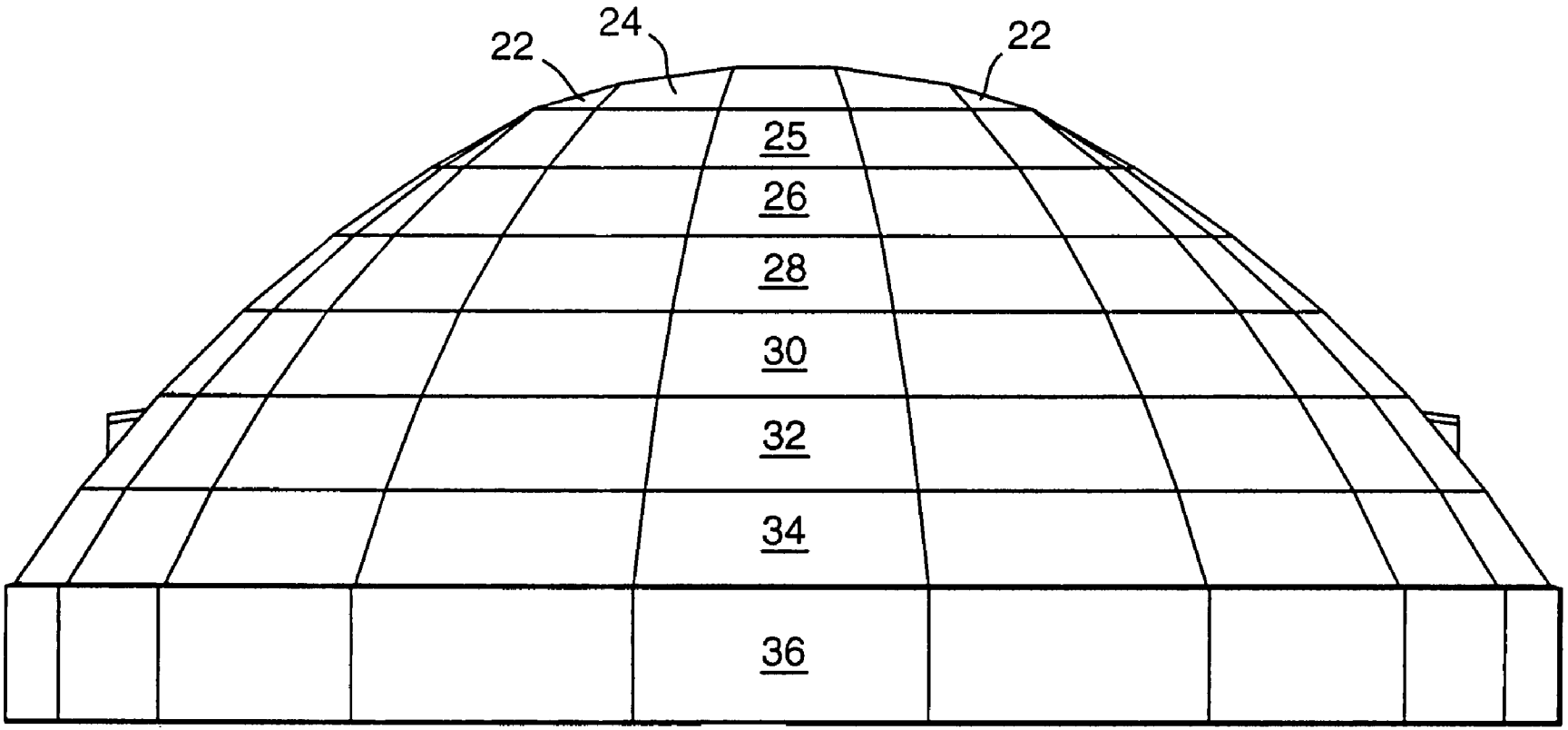
Figure 4:
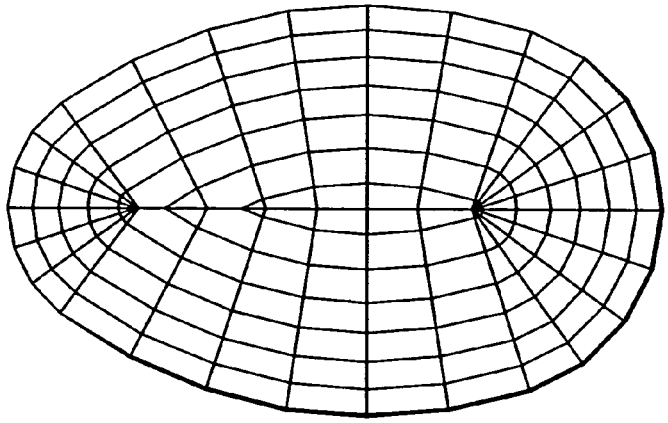
FIG. 4 is a plan view, FIG. 5 a side elevation view and FIGS. 6 and 7 elevation views from opposite ends, of another dome-like structure embodying the invention.
Figure 5:
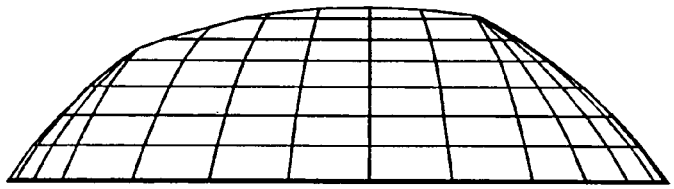
Figure 6:
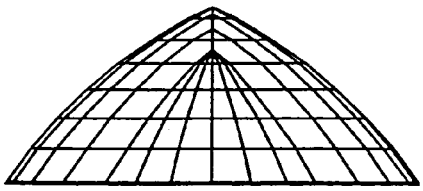
Figure 7:
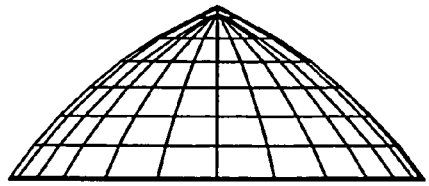

Referring to FIGS. 1 to 3, the domed structure shown comprises a roof or skin formed by a plurality of individual, flat, straight-edged panels fitted together edge to edge. The panels may form the entire supporting structure of the dome, or the panels may be supported on an underlying supporting framework or bracing. The panels may, for example, be individually glazed frames, bounded by frame members or spars, or may be unitary straight-edged panels of metal, plastics, plywood or the like.

The domed structure illustrated in FIGS. 1 to 3 comprises a central, uppermost part 20 and, disposed outwardly from and below the part 20, a plurality of concentric rings or frustums, each comprising a ring of panels connected edge to edge, each panel extending from the upper inner edge of the respective frustum to the lower outer edge thereof. In the arrangement shown in FIG. 1, the central portion 20 has an inverted boat shape comprising a pair of adjoining triangular panels 22 at each end, and, on each side, a series of adjoining quadrilateral panels 24, the series extending from the triangular panel 22 at one end to the triangular panel 22 at the other end, on the respective side. The lower edges of panels 22 and 24 form the periphery of the portion 20. Disposed immediately outwardly of and below the pail 20 is a frustum or ring comprising a series of interconnected trapezoidal panels 25, and (at the ends of the frustum, triangular panels 25*a*) with the upper edge of each panel 25 being coincident with the base of a respective panel 22 or 24 and with the lower edge of each panel 25 being parallel with the upper edge, and forming part of the lower edge of that ring or frustum, the panels 25 meeting one another along respective "lines of longitude" of the structure, (i.e. lines which lie in respective vertical planes). Likewise, in the arrangement shown, the two ends of the frustum 25, 25*a* each comprise five triangular panels 25*a*, disposed side by side, the panels 25*a* having their apices at their upper ends, coincident with the "point" of the "prow" or "stern" of the boat-shaped portion 20, and their bases forming respective parts of the lower periphery of the frustum, each panel 25 adjacent either end of the frustum having one side coincident with a side of the adjoining panel 25*a*. Likewise, disposed outwardly of and below the frustum of panels 25, 25*a* is a further frustum made up of trapezoidal panels 26 each having a shorter edge, forming part of the inner and upper edge of the frustum, adjoining and coincident with the lower edge of a respective panel 25, 25*a* each panel 26 having a parallel lower edge forming a respective part of the lower and outer edge of the respective frustum of panels 26.

In the same way, the frustum of panels 26 surmounts a further frustum of panels 28, which in turn surmounts a frustum of panels 30, surmounting a frustum of panels 32 which in turn surmounts a frustum of panels 34. The frustum of panels 34 finally surmounts a ring of panels 36. The upper and lower edge of each frustum lie in respective horizontal planes, with the junction between panels in the upper edge of each frustum being coincident with a corresponding junction between panels of the adjoining frustum above, and the panel edges extending between such upper and lower edges lying in respective "lines of longitude" (as defined above). The lowermost section of the structure may comprise panels 36 which are quite vertical, and provide a vertical circumferential wall of the structure, so that the lowermost section is a "cylinder" rather than a frustum. It will be noted, also, that the lowermost ring of panels 36 and the two sections or frustums 34, 32 above are interrupted at two locations (as shown) by doorway or portico arrangements 40.

Figure 10:
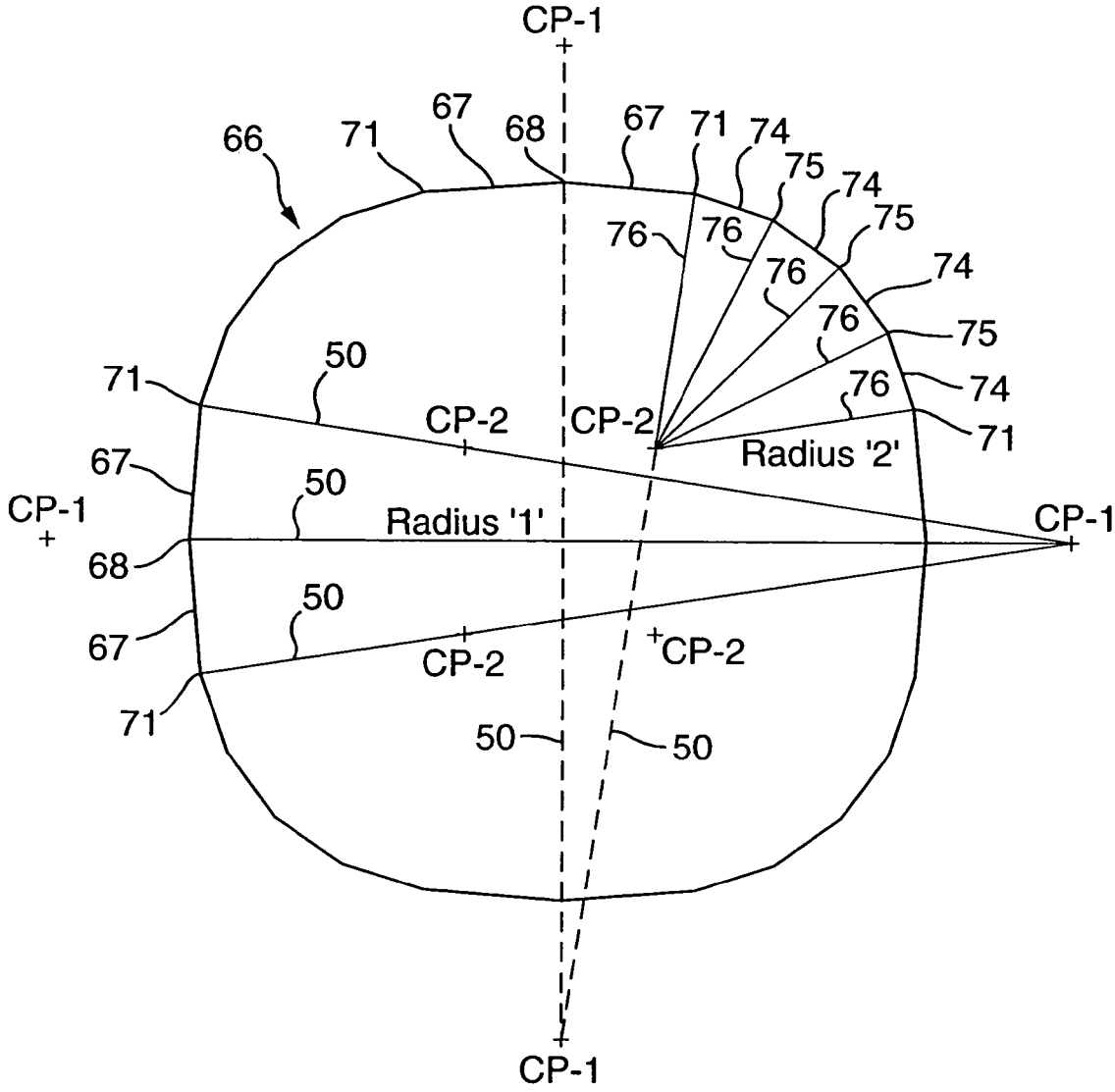

As will be appreciated from FIGS. 4 to 7, the structure is not circular in plan, as is conventional with domed structures, but is, in the case of the structure of FIGS. 1 to 7, oval in plan. In accordance with the invention, other embodiments may have other shapes in plan, for example, as shown in FIG. 10, a shape akin to a square with rounded corners. The circular plan shape of a conventional domed structure is to a considerable measure responsible for the rigidity and stability of such domed structures and departure from the traditional circular configuration of domed structures generally results in significant loss of such rigidity and stability unless, for example, additional bracing is employed and/or tensioning cables are resorted to. However, the inventor has discovered that such loss of stability or rigidity can be avoided to a significant degree by configuring such non-round domed structures in accordance with the set of rules explained below. Thus the inventor has discovered that stability and rigidity can be much improved if the form of a non-round domed structure is such that, at selected ones of a plurality of horizontal levels in the structure, for each set of three adjacent horizontally spaced points in the envelope or framework of the structure, either all three points are at equal radii from a point in the same plane or two adjacent ones of these three points are at a first equal radial distance from a point (herein termed a "locator point") in such horizontal plane and the remaining point is at the same distance as the adjoining point of said set from a point on a radius from said locator point to said adjoining point, or from a point on the production, beyond said locator point, of the last-mentioned radius. Thus, each segment forms, in plan, the base of an isosceles triangle, of which the sides are formed by the radii to the respective locator point.

Figure 8:
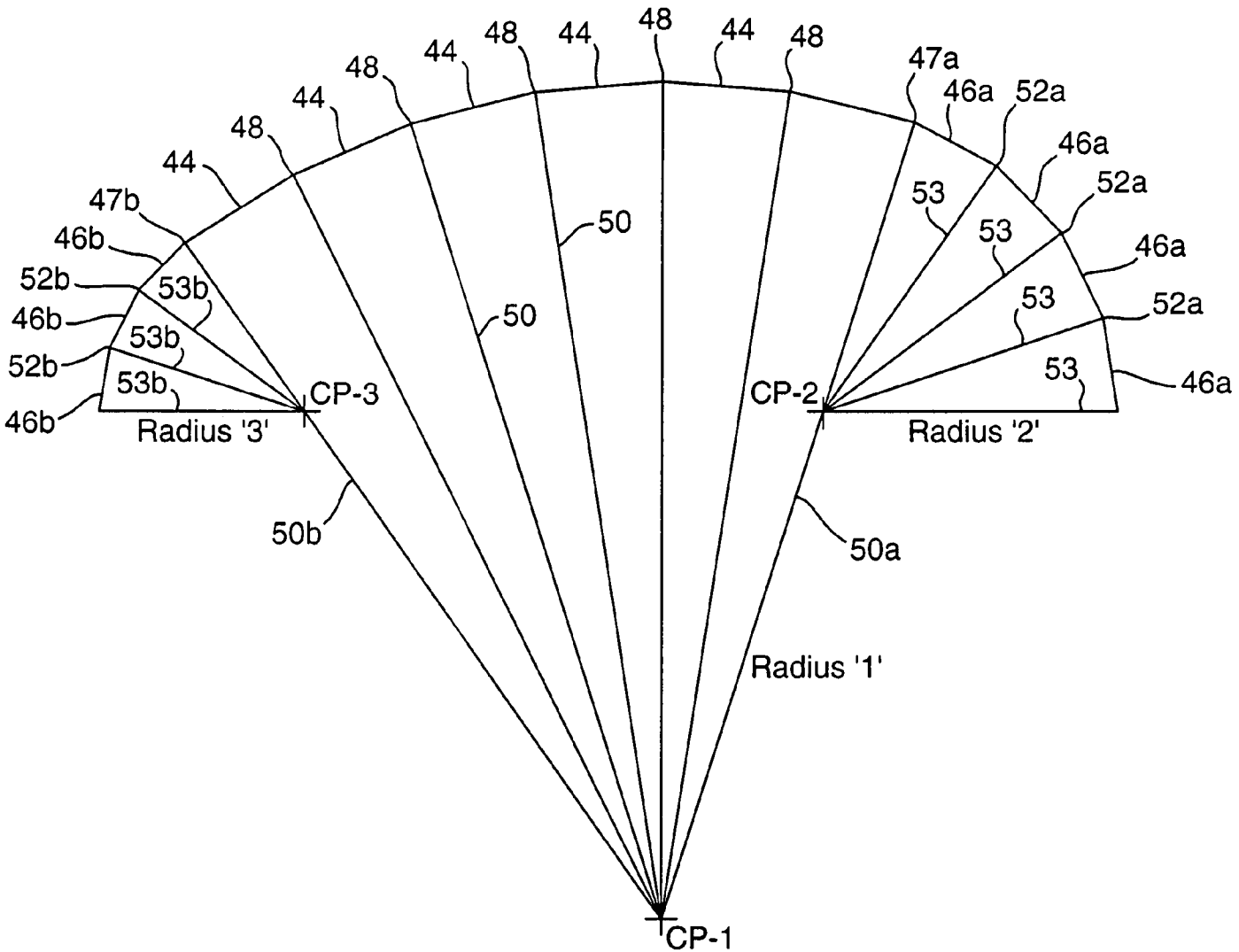
FIGS. 8, 9 and 10 are similar diagrams illustrating the principles of the present invention.

By way of example, FIG. 8 illustrates, schematically, part of a horizontal section through a domed structure in accordance with the invention, said partial horizontal section comprising a first portion formed by a series of segments 44 connected end-to-end and second and third sections, on either side of the first section, comprising segments 46*a* and 46*b* respectively connected end-to-end at points 52*a* and 52*b*. The segments 44, 46*a*, 46*b* in FIG. 8 may comprise the horizontal upper or lower edges of the panels of a ring or frustum of a domed structure similar to that of FIGS. 1 to 7, comprising a plurality of superimposed such rings or frustums, sized or configured to provide the structure (not shown). The segments 44, 46*a*, 46*b* forming a continuous span or arc in FIG. 8 may be horizontal spars providing the upper or lower edges of the frustum, in a structure comprising a framework of such spars, or may comprise the upper or lower edges of panels making up the respective frustum, or may even represent horizontal sections through such panels, in a cross section taken intermediate the upper and lower edges of such frustum.

In the arrangement of FIG. 8, adjacent segments 44 are connected end-to-end at points 48 which are at equal radial distances, represented by radii 50 in FIG. 8 from a locator point CP-1 in the same plane. The segments 46*a* of the second section are connected together end-to-end at points 52, whilst the segment 46*a* of the second section nearest the first section is connected with the adjoining segment 44 at a point 47*a*. Similarly, the segments 46*b* of the second section are connected end-to-end at further points 52*b* and the segment 46*b* of the second section nearest the first section is connected with the adjacent segment 44 of the first section at a further point 47*b*. Points 47*a*, 47*b* and 48 are all the same radial distance (indicated by radii 50, 50*a* and 50*b* respectively) from the locator point CP-1. The points 52*a* of the second section, and point 47*a*, are at shorter equal distances, (cf. radii 53 in FIG. 8) from a common locator point CP-2 on the radius 50*a*. Similarly, the points 52*b* of the third section, and point 47*b* are at still shorter equal radial distances (cf. radii 53*b*) from a further common locator point CP-3 on the radius 50*b*. It will be appreciated that, in FIG. 8, whilst segments 44, 46*a* and 46*b* represent physical components, the illustrated radii 50, 50*a*, 50*b*, 53*a* and 53*b* merely represent distances from the respective points CP-1, CP-2 and CP-3 and do not, or do not necessarily, correspond to any physical components. Likewise, points CP-1, CP-2 and CP-3 need not correspond to any physical components.

Figure 9:
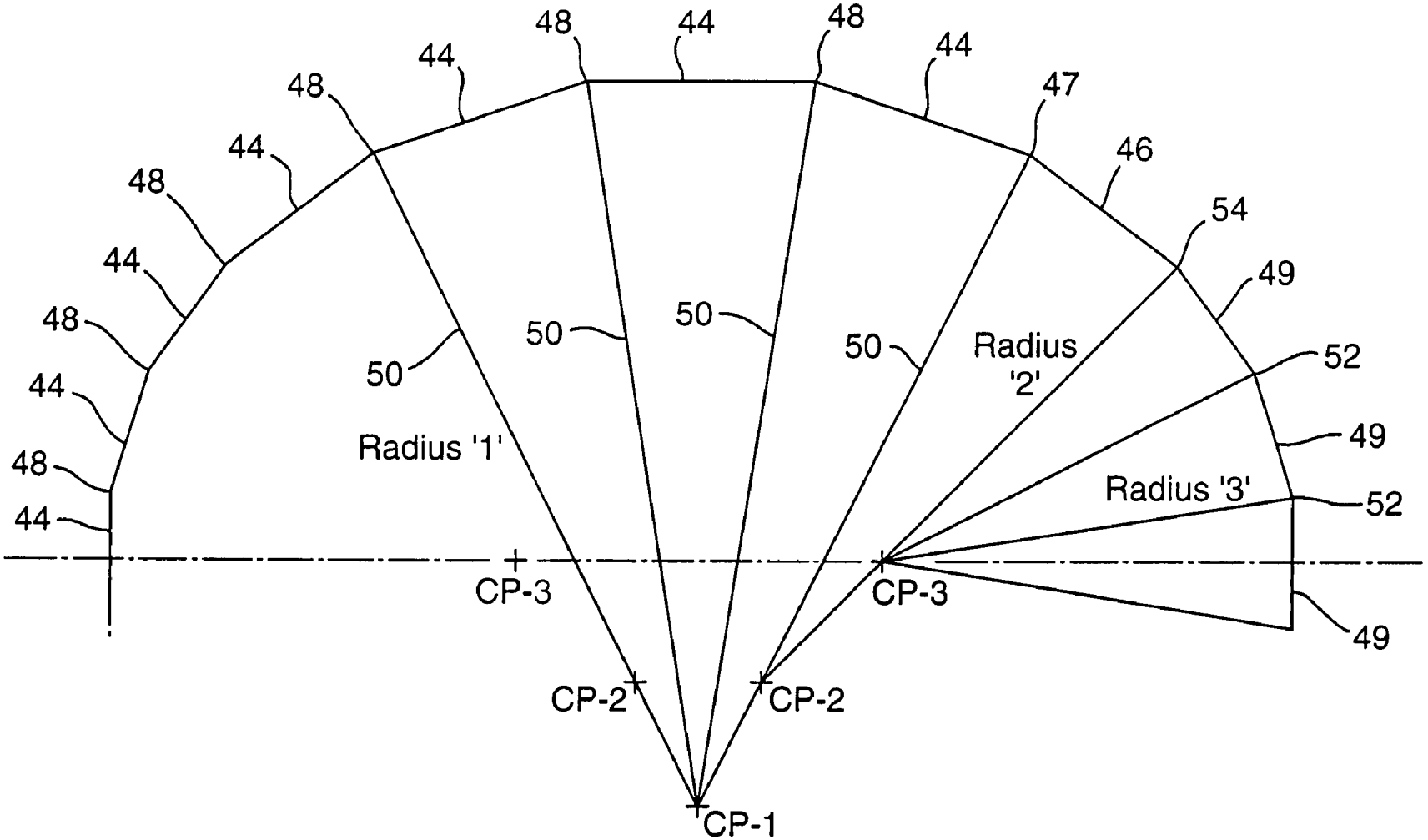

FIG. 9 is a diagram similar to FIG. 8 in which, however, a first section of the frustum periphery comprises a first series of segments 44 connected end-to-end at points 48, a second section comprises a segment 46 connected to the adjacent segment 44 at point 47 at the same radial distance 50 from a locator point CP-1 as points 48, and a third section comprises segments 49 connected together end-to-end at points 52, the segment 46 being connected to the adjacent segment 49 at a point 54. The point 54 and the point 47 are at equal radial distances (indicated as "Radius '2' ", shorter than radii 50) from a point CP-2 on the radius from point CP-1 to point 47. The point 54 and the points 52 are equal radial distances (indicated as "Radius '3' ") from a locator point CP-3 on the radius from point CP-2 to point 54.

FIG. 10 illustrates, schematically, a horizontal section through a domed structure in accordance with the invention, utilising the same principles as exemplified with reference to FIGS. 8 and 9. In FIG. 10, the polygonal shape 66 approximating to a square with rounded corners may comprise the horizontal upper or lower edges of the panels of a ling or frustum of a domed structure comprising a plurality of superimposed such rings or frustums, sized or configured to provide a generally domed structure (not shown). The line segments forming the polygon 66 may comprise horizontal spars providing the upper or lower edges of the frustum, in a structure comprising a framework of such spars, or may comprise the upper or lower edges of panels making up the respective frustum, or may represent horizontal sections through such panels.

The polygonal frustum boundary illustrated in FIG. 10, comprises four similar "side sections" and four similar "corner sections" each interposed between two adjacent side sections. Each "side section" comprises two equal segments 67 the ends of which are at equal radial distances, represented by radii 50, from a respective locator point CP-1 in the same plane and (in this instance, outside the polygon 66), whilst the "corner sections" each comprises a series of four equal segments 74 the ends of which are at equal shorter radial distances, represented by radii 76 from a respective common locator point CP-2 within the frustum 66. The two segments 67 of each "side section" are connected end-to-end at a respective point 68 and are connected to the adjoining segments 74 at respective points 71. The segments 74 of each "corner section" are connected end-to-end at points 75. Each point CP-2 lies on the radius from the junction 71 between the respective segment 74 at the end of the corner section and the adjoining segment 67, from the respective locator point CP-1 applying to the last-mentioned segment 67. For clarity, radii 50 are shown in FIG. 10 for only two "side sections" of the figure and radii 76 for only one "corner section".

It will additionally be noted in FIGS. 1 to 10 that for panels 25 to 36, (and corresponding segments 44 to 49; 67, 74, etc.) in any particular frustum, the radial distance (50, 76) to the respective locator point (CP-1, CP-2, CP-3 etc.), is greater the horizontal dimension of the respective segment or panel. This principle may be implemented in various ways. For example, the structure may be so configured that, at the horizontal level of each frustum, the isosceles triangle defined by the respective segment or horizontal panel edge and the two equal radii extending to the respective locator point is similar, in the geometrical sense, to the other such triangles at the horizontal level of that frustum. Typically, also, such triangles at the level of the upper or lower edge of each horizontal frustum in the structure may also be similar, in the geometrical sense, to such triangles at the levels of the upper or lower limits of any other frustum in the structure.

Figure 11:
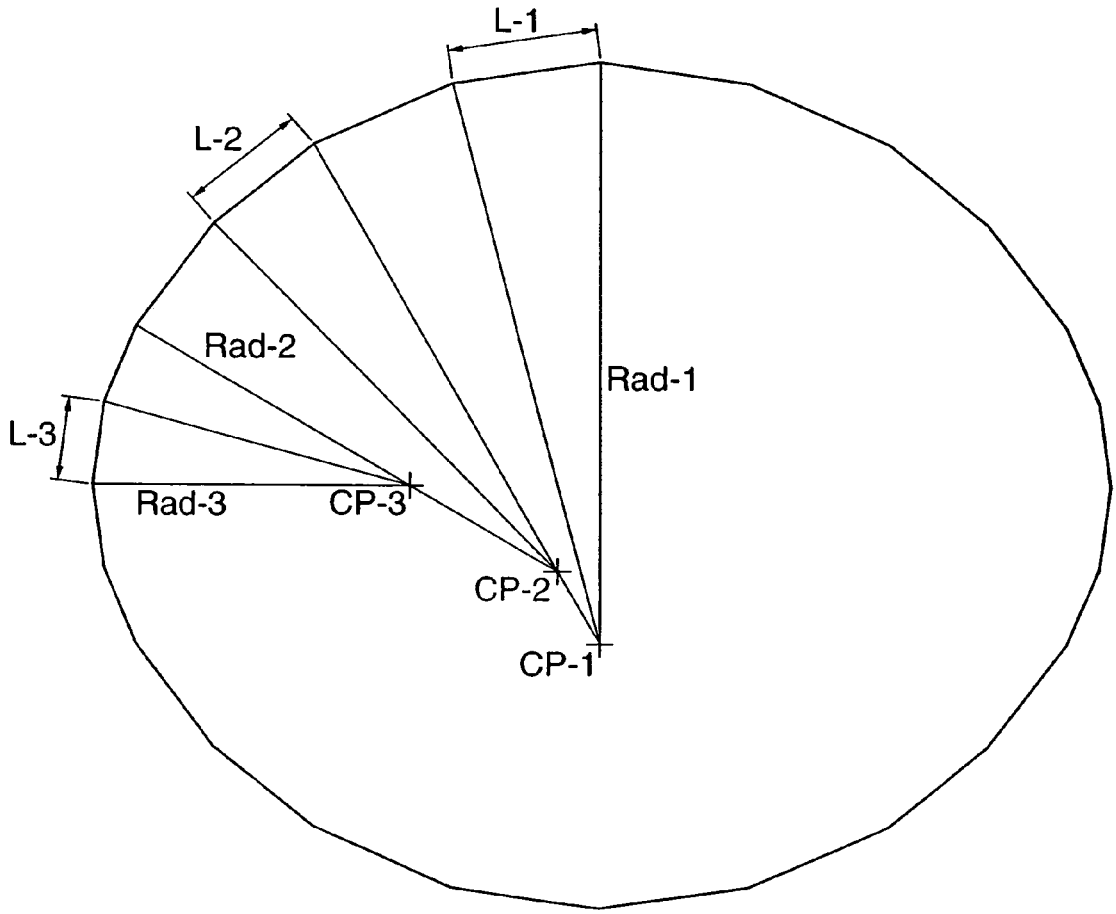
FIG. 11 is a diagram similar to FIGS. 8, 9 and 10, illustrating further features of preferred embodiments of the invention.

Thus, referring to FIG. 11, which is a schematic diagram similar to FIGS. 8, 9 and 10, the horizontal lengths of respective segments or horizontal panel edges are indicated at L-1, L-2 and L-3, respectively for segments having respective locator points CP-1, CP-2 and CP-3, respectively at radial distances RAD-1, RAD-2 and RAD-3 respectively from their respective locator points. RAD-1 is greater than RAD-2 which in turn is greater than RAD-3 and correspondingly L-1 is greater than L-2 which in turn is greater than L-3. Preferably L-1/RAD-1=L-2/RAD-2=L-3/RAD-3.

In general, as compared with a dome structure having a circular "footprint" (i.e. shape in plan) by increasing the horizontal lengths of the panels in increments, the shape of the footprint is changed. It is beneficial to the structure to ensure that the joint lines of a segment of panels with the same length project radially to a common centre point or locator point.

The invention allows an elongated dome-like structure to be produced which does not need any additional supports such as vaulted structures. This greatly increases the economy of the structure and lowers the cost per ton of material stored in the structure.

It will be understood that, in practice, the spars or panels making up the structure will have a finite thickness and that in practice it may be sufficient for the points meeting the above-noted geometrical conditions to be located somewhere within such thickness or even slightly outwardly or inwardly of the physical panel or spar, without significant loss of the advantages of the invention and thus without falling outside the scope of the invention.

It will be understood that whilst one of the objects of the invention is to minimise the need for additional bracing or support, a domed structure in accordance with the invention may be braced internally or externally, for example by struts or ties extending between the non-adjacent junctions of panels, or between such junctions and independent anchor points.

Whilst, for simplicity, the embodiments of the invention exemplified above have consisted, in effect, of a plurality of superimposed frustums of horizontal "slices" each having a more or less independent structural identity, it will be understood that the invention is not restricted to structures constructed in this way and that the same principles are applicable, for example, to structures formed by interdigitated polygonal panels at different horizontal panels, or which, for example, are constructed as a series of adjoining vertical sectors or slices.

What is claimed is:

1. A dome-like structure which is non-circular in plan, comprising a plurality of parts disposed one above the other and including an apex part and one or more lower parts each forming a respective frustum adjoining the part immediately above, the structure being formed of a plurality of substantially straight-edged panels, the panels in each said frustum being trapezoidal in shape, the panels meeting one another along lines which lie in respective vertical planes, the edges of said panels each extending between a respective pair of points, on the exterior of the structure, and wherein said points are disposed at selected ones of a plurality of horizontal levels in the structure and wherein, at each said level, said points do not all lie upon a common circle, characterized in that, for each set of three adjacent horizontally spaced said points, either (a) all of the three points are at equal radii from a point, herein for convenience termed a locator point, for that set, in the same plane, or (b) two adjacent ones of the three points are at a first equal radial distance from a point, herein for convenience termed a locator point, for that set, in said plane and the remaining point of the three points is at the same distance as the adjoining point of said set of three from a point on a radius from said locator point to said adjoining point, whereby each horizontal edge of a said panel at a said horizontal level forms, in plan, the base of an isosceles triangle of which the sides are formed by the radii to a respective said locator point, and, at each of said horizontal levels in the structure, the ratio of the horizontal length of a said horizontal edge extending between two adjacent said points to the radial distance of these points from the locator point for these points, is the same from said horizontal edge to said horizontal edge, and wherein each said locator point, lies in the same vertical plane as locator points, in said levels above or below.

2. A dome-like structure according to claim 1 wherein, at each said horizontal level, said distances, for all said points on the exterior of the structure, have a magnitude selected from only two values, fixed for said each said horizontal level.

3. A dome-like structure according to claim 1 wherein, at each said horizontal level, said distances, for all said points on the exterior of the structure, have a magnitude selected from only three values, fixed for said each said horizontal level.

4. A dome-like structure according to claim 1, wherein at a said horizontal level, a first section of the structure is formed by a series of such horizontal panel edges connected end to end at points which are at equal radial distances from a first said locator point in the same plane, and, on either side of said first section, a second section and a third section respectively, forming a continuous span or arc therewith, said second section comprising a series of such edges connected end to end with each said edge in said second section extending between points which are at an equal shorter distance from a second said locator point in the same plane, and said third section comprising a series of such horizontal panel edges connected end to end with each said edge in said third section extending between points which are at an equal shorter distance from a third said locator point in the same plane.

5. A dome-like structure which is non-circular in plan, comprising a plurality of parts disposed one above the other and including an apex part and one or more lower parts each forming a respective frustum adjoining the part immediately above, the structure being formed of a plurality of substantially straight-edged panels, the panels in each said frustum being trapezoidal in shape, the panels meeting one another along lines which lie in respective vertical planes, the edges of said panels each extending between a respective pair of points, on the exterior of the structure, and wherein said points are disposed at selected ones of a plurality of horizontal levels in the structure and wherein, at each said level, said points do not all lie upon a common circle, characterized in that, for each set of three adjacent horizontally spaced said points, either (a) all of the three points are at equal radii from a point in the same plane, the last said point being a locator point, for that set, in said plane, or (b) two adjacent ones of the three points are at a first equal radial distance from a point, the last said point being a locator point, for that set, in said plane and the remaining point of the three points is at the same distance as the adjoining point of said set of three from a point on a radius from said locator point to said adjoining point, whereby each horizontal edge of a said panel at a said horizontal level forms, in plan, the base of an isosceles triangle of which the sides are formed by the radii to a respective said locator point, and, at each of said horizontal levels in the structure, the ratio of the horizontal length of a said horizontal edge extending between two adjacent said points to the radial distance of these points from the locator point for these points, is the same from said horizontal edge to said horizontal edge, and wherein each said locator point, lies in the same vertical plane as locator points, in said levels above or below.

6. A dome-like structure according to claim 5 wherein, at each said horizontal level, said distances, for all said points on the exterior of the structure, have a magnitude selected from only two values, fixed for said each said horizontal level.

7. A dome-like structure according to claim 5 wherein, at each said horizontal level, said distances for all said points on the exterior of the structure, have a magnitude selected from only three values, fixed for said each said horizontal level.

8. A dome-like structure according to claim 5, wherein at a said horizontal level, a first section of the structure is formed by a series of such horizontal panel edges connected end to end at points which are at equal radial distances from a first said locator point in the same plane, and, on either side of said first section, a second section and a third section respectively, forming a continuous span or arc therewith, said second section comprising a series of such edges connected end to end with each said edge in said second section extending between points which are at an equal shorter distance from a second said locator point in the same plane, and said third section comprising a series of such horizontal panel edges connected end to end with each said edge in said third section extending between points which are at an equal shorter distance from a third said locator point in the same plane.

* * * * *

UNITED STATES PATENT AND TRADEMARK OFFICE

CERTIFICATE OF CORRECTION

PATENT NO. : 7,269,926 B1
APPLICATION NO. : 10/399106
DATED : September 18, 2007
INVENTOR(S) : Ferenc Rakosi It is certified that error appears in the above-identified patent and that said Letters Patent is hereby corrected as shown below:

Column 5, line 4, “ling” should read --ring--; and

Column 8, line 24, (Claim 7) “distances” should read --distances,--.

Signed and Sealed this

Fifth Day of August, 2008

JON W. DUDAS
*Director of the United States Patent and Trademark Office*